US006810776B1

(12) United States Patent
Green

(10) Patent No.: US 6,810,776 B1
(45) Date of Patent: Nov. 2, 2004

(54) SLIDING-TOOLBAR GARBAGE DISPOSAL UNJAMMING DEVICE

(76) Inventor: Ronald Michael Green, P.O. Box 418, Norwich, VT (US) 05055

( * ) Notice: Subject to any disclaimer, the term of this patent is extended or adjusted under 35 U.S.C. 154(b) by 0 days.

(21) Appl. No.: 10/357,858

(22) Filed: Feb. 4, 2003

(51) Int. Cl.[7] ..... B25B 13/48
(52) U.S. Cl. ..... 81/488; 81/177.15; 81/442
(58) Field of Search ..... 81/488, 176.1, 81/176.15, 176.2, 119, 436, 442, 177.5, 126

(56) References Cited

U.S. PATENT DOCUMENTS 587,228 A * 7/1897 Orton ..... 254/199
949,083 A * 2/1910 Mossberg ..... 81/177.5
970,371 A * 9/1910 Greggs ..... 81/176.2
1,476,007 A * 12/1923 Rude ..... 81/436
2,463,138 A * 3/1949 Bamberg ..... 81/177.5
2,803,981 A 8/1957 Stoecker
3,213,720 A 10/1965 Wallis et al.
4,050,334 A 9/1977 Davis, Jr.
5,685,209 A 11/1997 Fiedler
D396,616 S * 8/1998 McCallum ..... D8/22

* cited by examiner

*Primary Examiner*—Hadi Shakeri

(57) ABSTRACT

A garbage disposal unjamming device having a vertical shaft 14, a horizontal handle 10 at one end of the shaft, and at the other end of the shaft, a straight horizontal toolbar 16. The toolbar is slidably secured to the shaft through a transverse passage 20 in the shaft. The toolbar's ends 18 are slightly flared to prevent it from slipping out. When the toolbar is moved entirely to one side of the shaft so that one flared end is adjacent to the shaft, the toolbar can be angled into or out of the narrow sink opening of the disposal unit. Inside the unit, the toolbar is tapped to center it on the shaft. In this position it can engage the two opposing cutters on the rotor plate to rotate the plate and unjam the disposal unit.

3 Claims, 7 Drawing Sheets

SLIDING-TOOLBAR GARBAGE DISPOSAL UNJAMMING DEVICE

CROSS-REFERENCE TO RELATED APPLICATIONS

Not Applicable

FEDERALLY SPONSORED RESEARCH

Not Applicable

BACKGROUND OF THE INVENTION-FIELD OF INVENTION

This invention relates to devices for freeing the jammed rotor plate and cutters of a garbage disposal device.

BACKGROUND OF THE INVENTION

Garbage disposal units commonly installed in kitchen sinks are prone to jamming. Such disposals have a narrow drain aperture in the sink floor that opens into a wider chamber below. At the base of this chamber is a flat circular plate. Two upraised detents or cutting blades are mounted at the opposing edges of this plate. When the motor spins this plate via a shaft from below, waste is thrown outward on the plate to the cutting blades. There it is pulverized by the rotational speed of the blades and by being pressed between the blades and the outer wall of the disposal chamber. Water from the sink then washes the pulverized material out, down, and away.

Jamming occurs when a hard piece of waste, such as a pit or bone fragment,becomes lodged between moving parts of the unit, such as the rotor plate and outer wall of the chamber or in the region where the power shaft enters the chamber from below. To overcome this jamming, it is necessary to work the waste fragment out either by rotating the plate backward and forward, or by further crushing the fragment by turning the circular plate in its accustomed direction with considerable force. Householders often try to do this with a kitchen utensil, broomstick, or long screwdriver. However, because of the shape of the disposal with its narrow sink drain opening, it is very difficult to apply force in the proper lateral direction to the cutters and thereby unjam the plate. In some cases a great deal of force must be applied because the previous rotation of the plate or efforts to free it have more firmly wedged the waste fragment in place. In such circumstances, the efforts to unjam the disposal may damage it. In the end, many homeowners are forced to call a plumber who disassembles the unit or replaces it. Throughout this process, homeowners are often tempted to insert their hands into the disposal unit. Should the power be turned on while this is happening, grievous injuries can result.

Inventors have previously tried in several ways to address this problem of the need safely to exert considerable torque in the unusual confines of an installed disposal unit. U. S. Pat. No. 4,050,334 to Davis, Jr. (1977) discloses a wrench shaped roughly in the shape of a zee (See Prior Art, FIGS. 7A and 7B). The wrench is in the form of a shaped single-piece of metal with a straight, vertical shaft section. The handle end of the wrench is bent at an acute angle to the axis of the shaft section, and the opposing toolbar end is bent in the plane of the handle section to lie perpendicular to the shaft section. The toolbar section is long enough to engage both cutting blades on the rotor plate, but too long, when held in its working, horizontal position, to fit through the narrow sink opening. By angling the tool section into a semi-vertical position, it is possible to insert the toolbar end through the sink opening and then position it flat against the rotor at the bottom. In this position, with the shaft section now vertical, the handle end, which is bent out from the shaft in the opposite direction of the toolbar end, is turned to rock the rotor back and forth. In this design, however, several factors limit the amount of lateral force that can be applied to the cutters. The zee shape of the wrench causes one of the two cutters to be engaged primarily as a pivot for the turning procedure. The shape of the device also causes the shaft to rotate about an axis somewhat offset from the central access of the rotor plate. As a result of these factors, most of the lateral force is applied to the second, opposing cutter at the free end of the toolbar. This force is reduced by the reverse lever effect of its being exerted at the relatively distant tip of the toolbar. This unbalanced application of lateral force to the two cutters significantly reduces the amount of torque that can be applied to the underlying rotor plate. In the absence of sufficient force, many serious jams cannot be overcome and may even be worsened. A further problem is that the thin, vertical metal shaft of this one-piece device cannot be securely grasped to apply turning force.

U.S. Pat. No. 2,803,981 to Stoecker (1957), U.S. Pat. No. 3, 213,720 to Wallis et al. (1965) and U.S. Pat. No. 5,685, 209 to Fiedler (1997) take a different approach to this problem. All disclose a single vertical shaft attached to a handle at the top, and, at the bottom, to the toolbar. The toolbar is connected at its center to the shaft at the shaft's bottom end and the toolbar is allowed, by means of a hinge, rivet, or nut and bolt arrangement, to pivot at its connection point. To permit the toolbar's insertion into the sink opening, the toolbar is tilted up on one of its sides so as to lie close to the shaft and extend away from the shaft on the other. Once inside the chamber of the disposal, the toolbar can be flattened out to its working horizontal position by being pressed against the rotor. Since the toolbar is attached at its center to the vertical shaft, this permits more equal application of torque to the rotor than the single-piece zee design.

However, this approach also has problems. It requires considerable torque to be applied to the toolbar at the weakest point of the entire device: the single hinge, rivet, or bolt connection that permits the toolbar to pivot at the base of the shaft. Whatever means are used to design this pivoting attachment, the repeated application of a great amount of torque at this point can easily cause the pivot to loosen, bend or break over time. If the pivot is even slightly bent out of shape, the toolbar may then be stuck in the horizontal position, making its removal from the narrow sink aperture very difficult, adding a further serious problem to the original one of jamming. This situation invites the homeowner to insert a hand into the disposal chamber to free the stuck toolbar, with the attendant risks of such an action. Returning the toolbar to a semi-vertical position for removal through the narrow opening is also a problem in this design. The U.S. Pat. No. 5,685,209 to Fiedler (1997) seeks to remedy this in one embodiment by making one side of the toolbar slightly longer than the other, allowing gravity to pull the resulting heavier side down. However, this inequality of lengths decenters the axis of the shaft from that of the rotating plate and reduces the equality of force applied to the cutters. The required looseness of the pivot for this solution is also easily threatened by dirt in the disposal chamber or any deformation of the pivot point caused by torque applied at that point. In another embodiment in the U.S. Pat. No. 5,685,209 to Fiedler (1997), a spring 150 is used to hold the toolbar in a semi-vertical position until pressed against the rotor plate (See Prior Art FIG. 8A). In another embodiment of the same patent (Prior Art FIG. 8B), a pull rod 152 is used to angle the bar up for removal. Such mechanisms are particularly subject to damage in the dirty environment of the disposal chamber and when great rotational force is applied to the tool. All pose the risk of leading the homeowner to insert a hand into the disposal chamber to free the stuck mechanism.

All garbage disposal unjamming devices face a common problem of inserting a toolbar long enough to exert balanced force to two cutters on opposite sides of the rotor plate yet also able to pass through the narrow drain opening. All such devices heretofore known suffer from one or more of a number of disadvantages:

(a) If the device is made of a single piece and formed so as to allow the toolbar to pass through the opening, the resulting shape does not permit a balanced application of lateral force in opposing directions to each cutter.

(b) If the problems of toolbar insertion and the need for central positioning are overcome by attaching the shaft to the toolbar at its center with a pivot, this results in great torque being applied to the device at its weakest point.

(c) Pivoting devices complicate the removal problem since there is no guarantee that the toolbar will re-assume the semi-vertical shape needed for removal. Efforts to correct this by weighting one side of the toolbar or by using springs or pull rods are unreliable in the dirty environment of the disposal chamber or if the application of torque deforms the tool at its vulnerable pivoting attachment point. All such mechanisms invite the homeowner to insert a hand into the disposal chamber to correct the problem.

(c) Reliance on single-piece construction and a pivoting attachment point normally causes the vertical shaft to be made of a narrow piece of metal, reducing its usefulness as a grasping point for steadying or turning the tool.

BACKGROUND OF THE INVENTION-OBJECTS AND ADVANTAGES

Several objects and advantages of the present invention are:

(a) to provide a device which, in one configuration, can pass easily through the narrow sink opening and, in a second configuration, can apply equal force in opposite directions to both cutters on a garbage disposal rotor plate;

(b) to provide a device in which, in its operating position, the shaft attaches to the toolbar at the toolbar's center and turns along the same axis as the disposal rotor plate, allowing maximal torque to be applied to the plate via the toolbar and the cutters;

(c) to provide a device in which maximal application of torque to the toolbar is possible with very little risk of the toolbar becoming stuck in its centered position as a result of deformation of the shaft-toolbar connection point;

(d) to provide a device which readily permits the shaft to be made at any desired thickness and of any strong material (wood, metal, or plastic) to facilitate grasping, steadying and turning of the device via the shaft; and (e) to provide a device in which the toolbar can easily and reliably be changed from its working configuration to its removal configuration without any special mechanisms that might become inoperable and invite the homeowner to insert a hand into the disposal chamber.

Still further objects and advantages will become apparent from a consideration of the ensuing description and drawings.

SUMMARY

The present invention is a garbage disposal unjamming device that relies on a sliding toolbar that passes horizontally through a passage at the bottom of the vertical shaft of the device. This sliding toolbar, which serves as a means of moving the cutters, is easily tapped to one side of the shaft for insertion into the disposal, tapped once inside the disposal chamber against the chamber wall to a centered position for application of torque to the cutters, and again tapped against the chamber wall to move it to one side of the shaft for removal from the chamber.

DRAWINGS—FIGURES

DETAILED DESCRIPTION—FIGS. 1 AND 2—PREFERRED EMBODIMENT

DRAWINGS—FIGURES

In the drawings, closely related figures have the same numbers but different alphabetic suffixes.

DRAWINGS—REFERENCE NUMERALS

Figure 1:
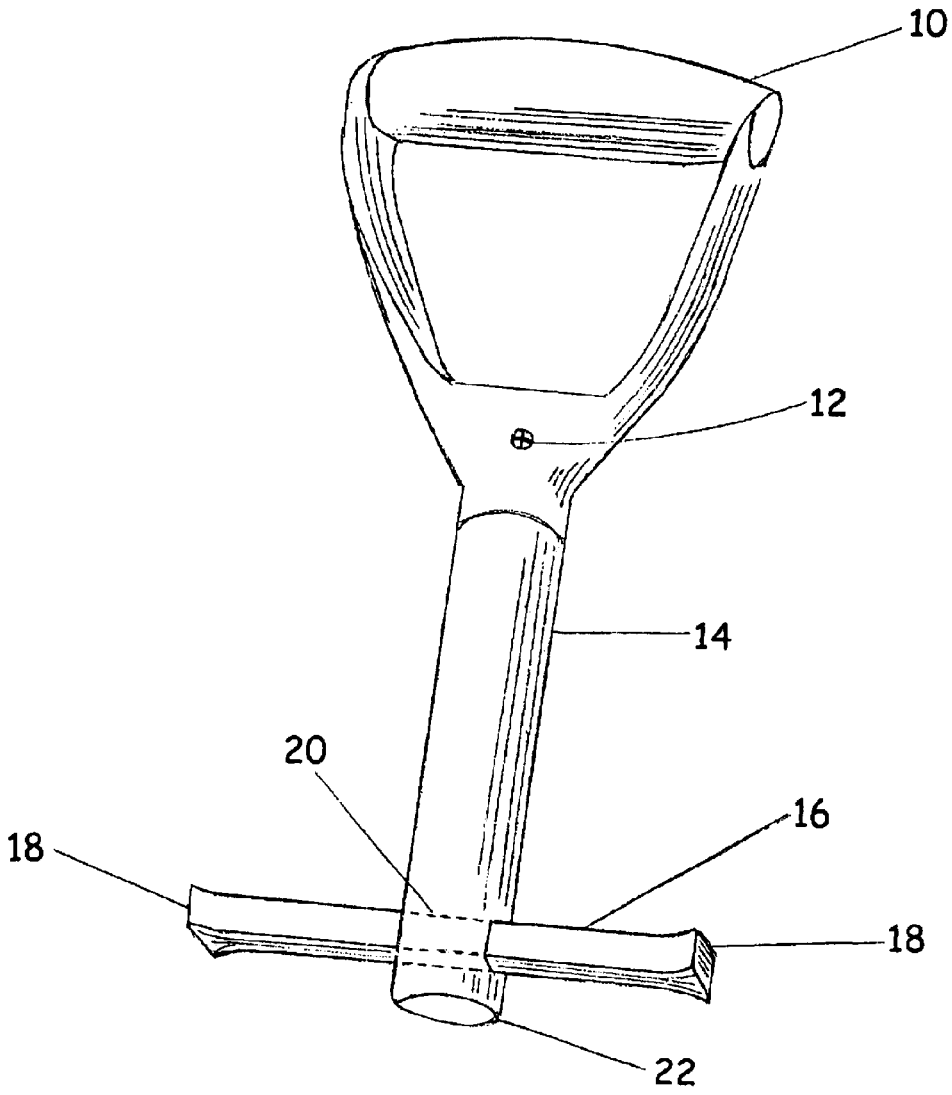
FIG. 1 is a perspective view (from below) of the preferred embodiment of the invention with the sliding toolbar shown in a centered position.
Figure 2:
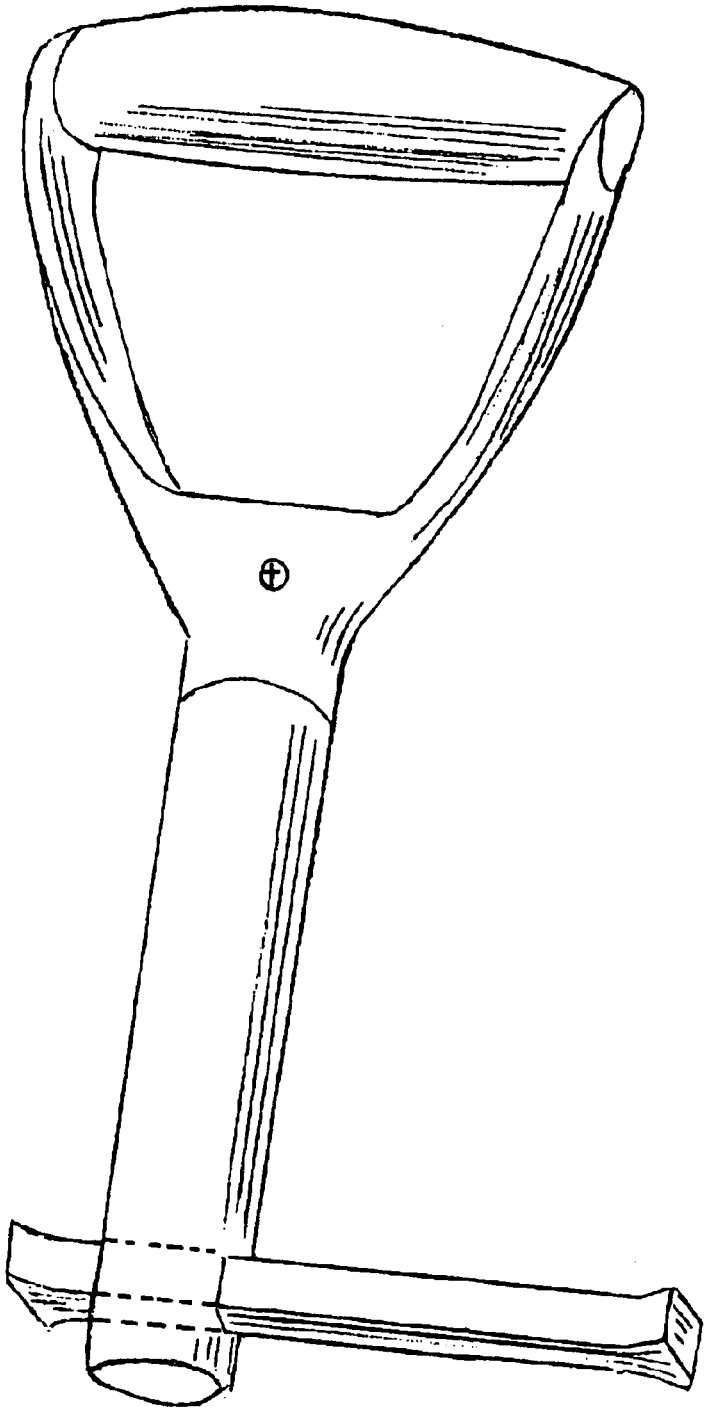
FIG. 2 is a perspective view (from below) of the preferred embodiment of the invention with the sliding toolbar shown moved to the right side of the shaft.

10 horizontal handle
12 screw or nut and bolt affixing handle to shaft
14 shaft
16 sliding toolbar
18 integral flared end of sliding toolbar
20 horizontal passage through shaft
22 bottom of shaft
26 sink drain opening into disposal unit
28 floor of sink
30 wall of chamber of disposal unit
32 rotor plate
34 cutter
36 motor shaft
38 carriage-type bolt with threaded end
40 retaining nut
42 channel
44 toolbar
46 end stop plate
52 additional horizontal turning bar
150 spring
152 pull rod DETAILED DESCRIPTION—FIGS. 1 and 2—PREFERRED EMBODIMENT A preferred embodiment of the present invention is illustrated in FIG. 1 (perspective view from below) and FIG. 2 (perspective view from below).

The device has a wood, metal, or plastic handle 10 joined to a hardwood or metal shaft 14 by means of a screw or nut and bolt 12. A horizontal passage 20 through the shaft adjacent to the base of the shaft and perpendicular to the shaft's longitudinal axis permits insertion of a sliding toolbar 16. The onepiece sliding toolbar is retained on the shaft by integral flared ends 18. The size of the passage 20 is the same as or only slightly larger than the sliding tool bar, permitting the tool bar to remain in whatever position it is placed but also to slide back and forth with minimal application of pressure.

Figure 4:
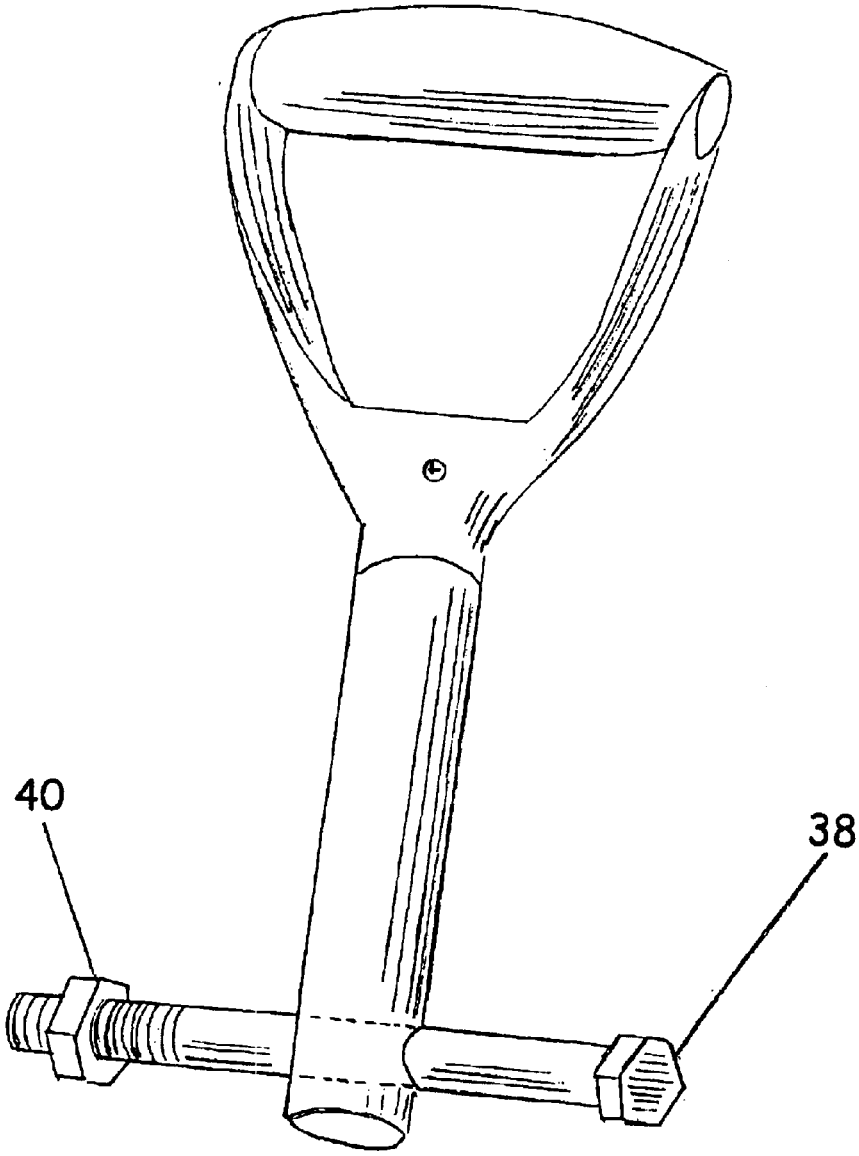
FIG. 4 shows an alternate embodiment of the invention having a sliding carriage-type bolt and retaining nut in place of the rectangular toolbar with retaining flared ends.
Figure 5:
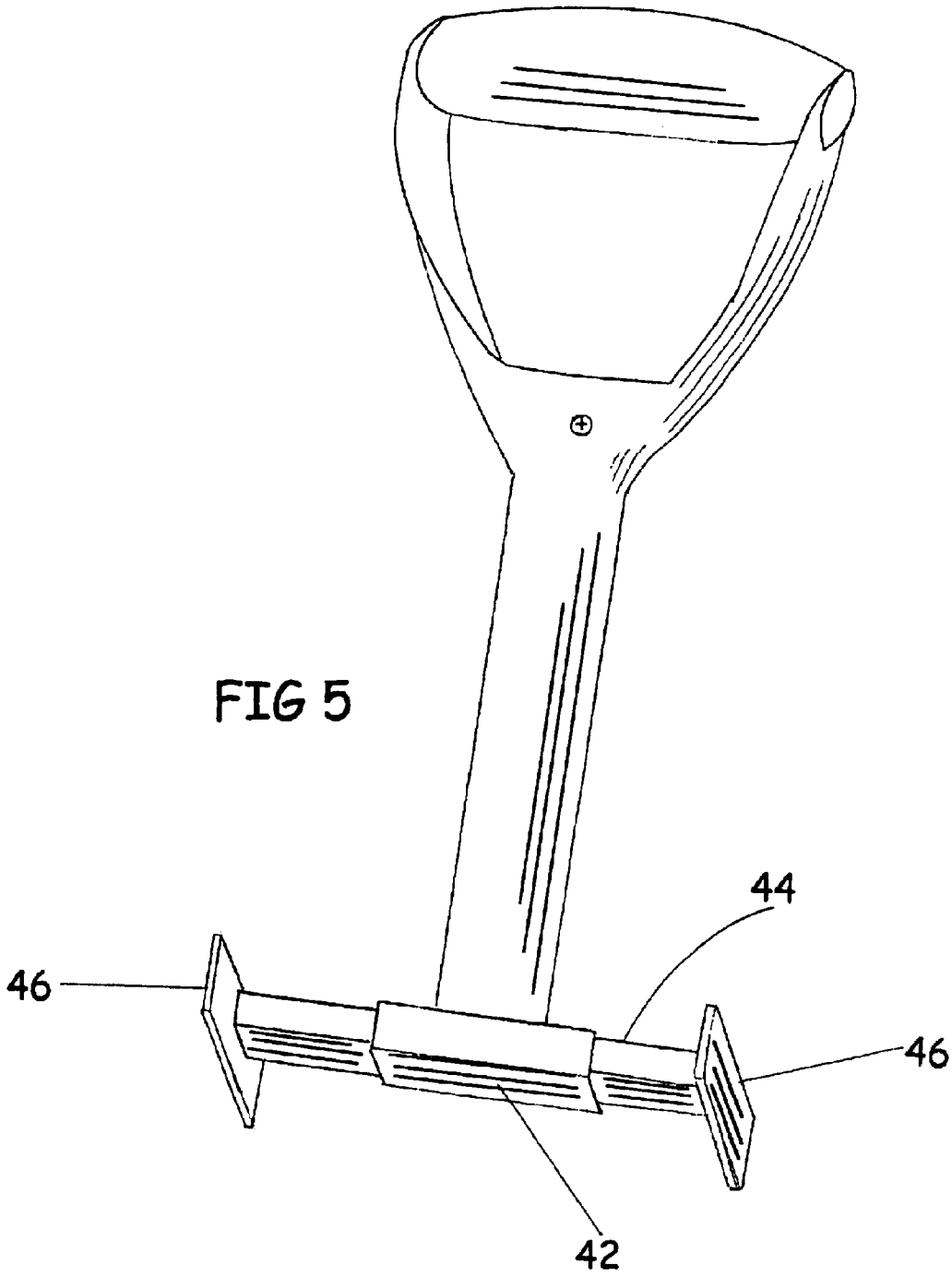
FIG. 5 shows an alternate embodiment of the invention having a separate channel for the sliding toolbar attached to the bottom of the shaft and separate plates attached to each end of the toolbar to prevent it from slipping out of the channel.

FIGS. 4 and 5—Alternate Embodiments

There are various possibilities with regard to the composition and shape of the invention's handle, shaft, or sliding toolbar. FIG. 4 shows a device with a carriage-type bolt 38 in place of the one-piece rectangular sliding bar with flared ends. A retaining nut or stop nut 40 is used to prevent the bolt from sliding off the shaft. FIG. 5 shows the device with a channel 42 securely attached to the bottom of the shaft. A toolbar 44 with attached end stop plates 46 is able to slide back and forth from one side of the shaft to the other through this channel.

Figure 6:
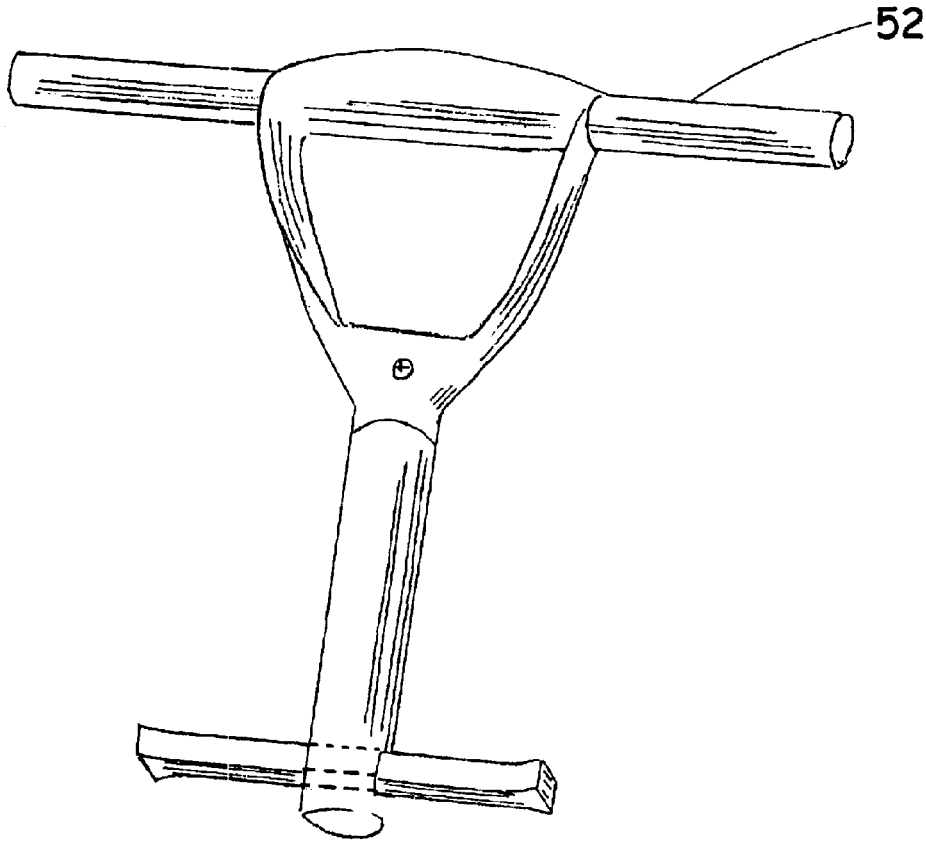
FIG. 6 shows the preferred embodiment of the invention fitted with an additional horizontal bar through the handle to amplify the torque that can be applied to the rotor plate.
Figure 7A:
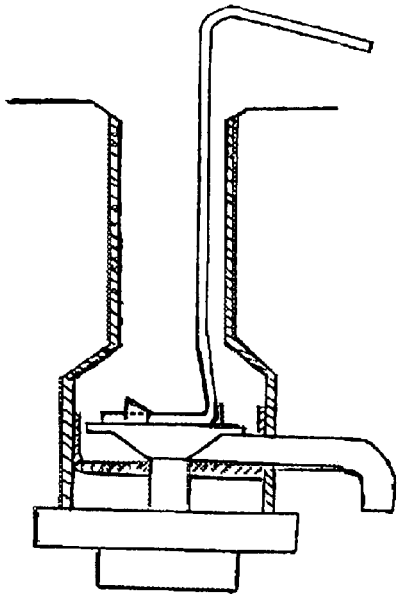
FIG 7A PRIOR ART
FIG. 7A shows a prior art device relying on a zee-shaped bent metal form to permit insertion and use of the device to free a jammed disposal unit.
Figure 7B:
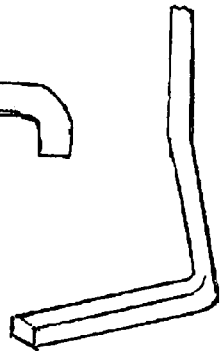
FIG 7B PRIOR ART
FIG. 7B shows a closer view of the toolbar end of the prior art device of FIG. 7A.
Figure 8A:
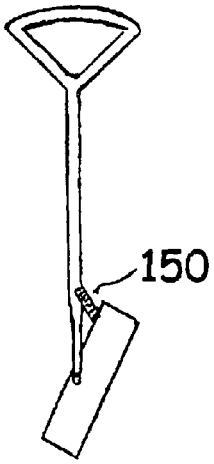
FIG 8A PRIOR ART
FIG. 8A shows a prior art device relying on a pivoting toolbar arrangement for insertion of the device and a spring to return the toolbar to its semi-vertical insertion/removal position.
Figure 8B:
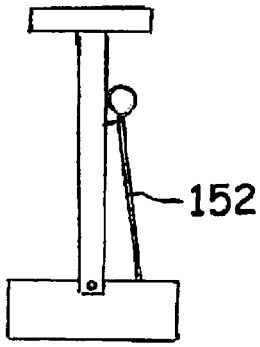
FIG 8B PRIOR ART
FIG. 8B shows a prior art device relying on a pivoting toolbar arrangement for insertion of the device and a pull rod to return the toolbar to its semi-vertical insertion/removal position.

FIG. 6—Additional Embodiment

The device can be fashioned to permit extra torque to be applied to the shaft and rotor plate. FIG. 6 discloses a perspective view (from below) of the preferred embodiment with an additional horizontal turning bar 52 passing through the opening in the horizontal part of the handle.

Figure 3B:
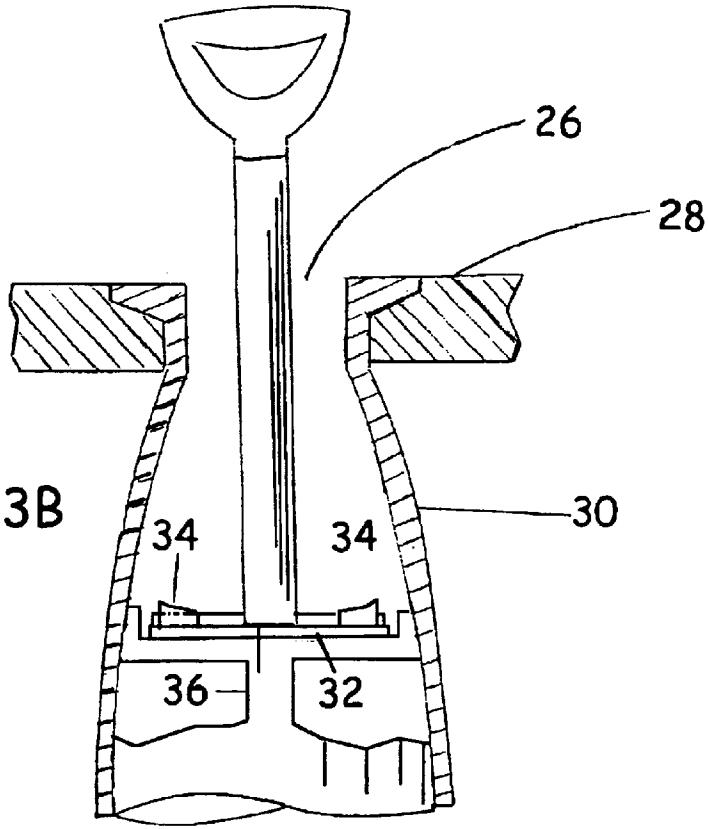
FIG. 3B shows a sectional view of a garbage disposal unit suspended beneath a sink bottom and the preferred embodiment of the invention with the toolbar positioned against each of the disposal unit's two opposing détente cutters on the rotor plate to rotate the plate and unjam the disposal unit.
Figure 3A:
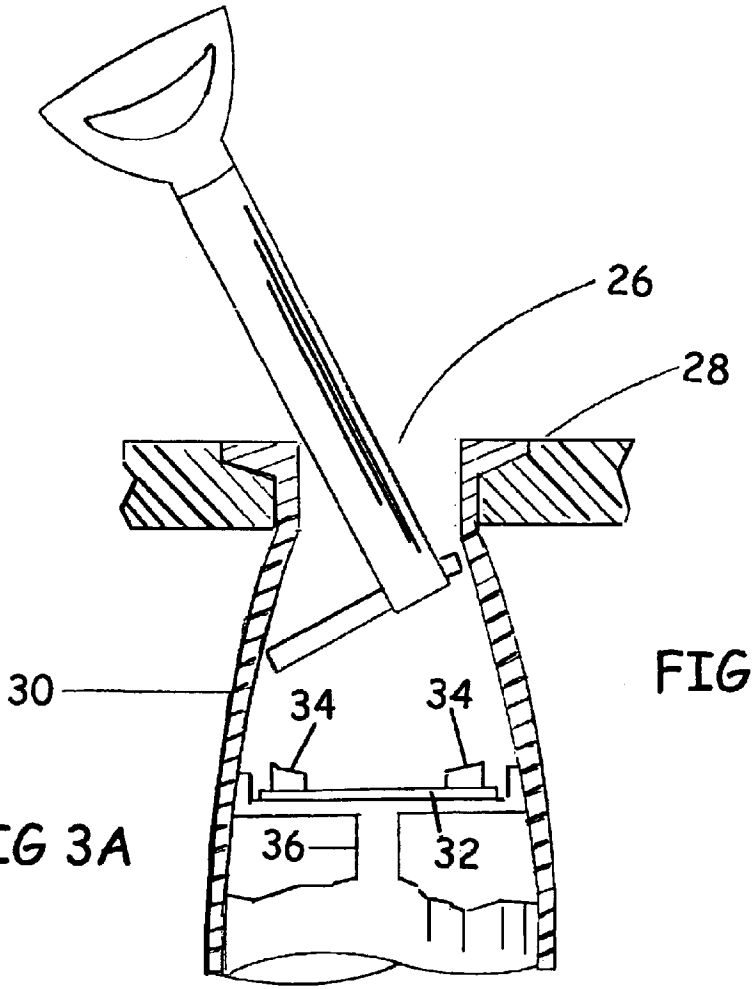
FIG. 3A shows a sectional view of a garbage disposal unit suspended beneath a sink bottom and the preferred embodiment of the invention being inserted into the chamber of the unit through the narrow, circular drain opening in the sink bottom.

Operation—FIGS. 3A and 3B

The sliding toolbar is long enough to engage each of the two cutters 34 when it is lying flat on the rotor plate 32 and bisecting the plate through the plate's center (FIG. 3B). In this position, however, the toolbar obstructs passage of the shaft either into or out of the narrow sink opening aperture 26 at the top of the disposal chamber. In order to insert the device into the disposal chamber, the sliding toolbar is moved or tapped to one side of the shaft. It can then be angled into the chamber (FIG. 3A). Once inside the chamber, the sliding toolbar can be tapped against the side of the chamber's wall 30 to center it on the device's shaft. In this position, it is ready to engage the cutters 34 (FIG. 3B). Turning the handle with one hand while steadying the shaft with a second hand permits maximal torque to be applied to the rotor plate in either a clockwise or counterclockwise direction in order to free the jammed rotor. Once the rotor has been unjammed, the device can easily be removed by again tapping the sliding toolbar against a wall of the disposal chamber 30 to move the bar to one side of the shaft. It can then be angled out of the chamber in the reverse of the way it was angled into it (FIG. 3A).

Advantages

From the above description, a number of advantages of my sliding toolbar unjamming device become evident:

(a) When the sliding bar is moved to one side of the shaft, the device is easily inserted through the narrow sink opening into a garbage disposal unit by means of a simple angling maneuver.

(b) Once in the unit, a tap of the sliding toolbar against the chamber centers the toolbar on the shaft and permits the bottom of the longitudinal axis of the shaft to be positioned on the center of the rotor plate, with the toolbar engaging each of the two cutters. Reversing this series of movements permits the bar to be moved to the side and angled for removal from the disposal unit.

(c) There is no pivoting or hinging mechanism to become deformed through the application of torque. Neither is there any need for springs or pull rods to reposition the toolbar for removal. As a result there is very little possibility of the toolbar becoming stuck in a position that prevents its removal from the disposal. Even if, as is very unlikely, the toolbar should become slightly bent on one side as a result of the application of great torque, the toolbar can still be moved to that side by tapping it firmly against the disposal chamber wall.

(d) The absence of any springs or cords needed to reposition the toolbar for removal minimizes the chances that the user might be tempted to correct a malfunction by inserting a hand into the disposal chamber. The use of a hand to clean or unjam a garbage disposal poses a major risk of injury.

(e) The fact that the bottom of the longitudinal axis of the shaft of this device is positioned directly on the center of the rotor plate and that, in the operating position, the sliding toolbar extends an equal distance from both sides of the shaft to the cutters, allows maximal torque to be applied to the rotor plate. This is in contrast to any single-piece angling device that joins the shaft to the horizontal toolbar at only one end of the toolbar.

(f) The use of a pivot arrangement in previous inventions to connect the shaft and toolbar normally leads the shaft to be narrow at the connection point and made of a very strong material such as metal. The lack of a need for such a pivot in this invention permits the shaft to be made of a single piece of wide-diameter wood, metal or plastic. This enhances the user's grip on the shaft and steadies the device during use.

(g) The same wide-diameter shaft readily permits the use of additional horizontal bars to increase the torque of the device.

(h) The use of a carriage-type bolt and nut as the toolbar as in one embodiment of the invention (FIG. 4) or attached end stop plates as in another (FIG. 5) permits easy replacement of the toolbar if the size of the garbage disposal unit requires a shorter or longer toolbar to engage the cutters.

CONCLUSION, RAMIFICATIONS, AND SCOPE

The unusual interior shape of a garbage disposal unit has posed a problem to those seeking to design an effective unjamming device. Such a device must be one that can be easily inserted into the unit and just as easily removed, with little or no risk of the device itself becoming stuck in the unit. The device must permit a user to apply maximal and controlled torque to the rotor plate. For this reason, the device shaft should be centered on the rotor plate during use in the chamber and the toolbar should extend out equally on both sides from the shaft to contact the cutters. However, such central positioning of the shaft and the toolbar, which is necessarily longer than the sink aperture is wide, poses a question of how the device can be inserted into or removed from the chamber. Some previous inventors have tried to solve this problem with devices having a pivoting or hinged toolbar, but this solution poses difficulties of its own.

The present invention solves the problem in a novel way by allowing the toolbar (in this case, a rectangular bar or otherwise shaped bolt) to slide back and forth in a horizontal passage or channel in the device shaft or firmly attached to it. Sliding the toolbar back and forth permits angled entry of the shaft and toolbar into the disposal chamber, centered positioning of the shaft and toolbar on the rotor plate for the application of torque, and angled removal of the bar and shaft at the completion of the unjamming procedure. Furthermore, this invention has the additional advantages in that:

- no delicate mechanisms are needed to return the device to its removal position;
- the arrangement that allows the toolbar to move between its insertion/removal position and its use position resists deformation no matter how much torque is repeatedly applied to the shaft and resists becoming stuck in its centered, operating position;
- the arrangement that allows the toolbar to move easily permits the device to employ a single-piece wide-diameter shaft that increases the user's grip and torque in applying the device;
- the toolbar can be fashioned with a removable retaining nut or stop end plates to permit the toolbar's replacement to suit differing diameters of the disposal rotator plate.

Although the description above contains many specificities, these should not be construed as limiting the scope of the invention but as merely providing illustrations of some of the presently preferred embodiments of this invention. For example, the invention can be made of different materials and its parts can have different shapes, such as circular, oval, trapezoidal; etc. The handle and shaft can be differently configured, and the sliding toolbar can be differently designed to engage the cutters.

Thus the scope of the invention should be determined by the appended claims and their legal equivalents, rather than by the examples given.

What is claimed is:

1. A method for freeing a jammed garbage disposal unit, said unit of the general type having a waste compartment suspended beneath a narrow drain opening on a floor of a sink, a rotor plate on the bottom of said waste compartment with two or more detente pulverize waste that is washed into said waste compartment through the drain opening, said method comprising;

a. providing a device having a horizontal handle secured at a proximal end of a vertical shaft and, immediately adjacent to a distal end of said shaft, a horizontal toolbar slidably secured to said shaft through a transverse passage, said toolbar being a single straight bar with two ends that are only slightly flared to prevent said toolbar from slipping out of said shaft, b. sliding said toolbar entirely to one side of said shaft so that one of said ends of said toolbar is proximate to said shaft and said shaft and toolbar are adapted to angle into the narrow sink drain opening of said disposal unit, c. angling said shaft and toolbar through said sink drain opening into said waste ,compartment d. tapping said toolbar against a side of said waste compartment or otherwise moving said toolbar to a centered position on said shaft, and e. engaging said detente cutters with said toolbar and turning the handle of said device to rotate and unjam said rotor plate.

2. The unjamming method of claim 1 wherein the step of providing a device comprises providing a device wherein said toolbar is a bolt.

3. The unjamming method of claim 1 wherein the step of providing a device comprises providing a device wherein at least one of said two flared ends of said toolbar is fitted with a means of removing the flared end of said toolbar in order to permit said toolbar to be slipped entirely out of the shaft of said garbage disposal device and replaced with a toolbar of a different length.

* * * * *